US010195866B2

(12) United States Patent
Shimomura

(10) Patent No.: US 10,195,866 B2
(45) Date of Patent: Feb. 5, 2019

(54) RECORDING APPARATUS

(71) Applicant: SEIKO EPSON CORPORATION, Tokyo (JP)

(72) Inventor: Masaki Shimomura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/505,670

(22) PCT Filed: Aug. 26, 2015

(86) PCT No.: PCT/JP2015/004286

§ 371 (c)(1),
(2) Date: Feb. 22, 2017

(87) PCT Pub. No.: WO2016/031243

PCT Pub. Date: Mar. 3, 2016

(65) Prior Publication Data

US 2017/0253050 A1 Sep. 7, 2017

(30) Foreign Application Priority Data

Aug. 29, 2014 (JP) ..... 2014-175120
Apr. 16, 2015 (JP) ..... 2015-083972

(51) Int. Cl.

| | |
|---|---|
| ***B41J 2/175*** | (2006.01) |
| ***B41J 29/02*** | (2006.01) |
| ***B41J 29/13*** | (2006.01) |

(52) U.S. Cl.

CPC ..... *B41J 2/17596* (2013.01); *B41J 2/175* (2013.01); *B41J 2/1752* (2013.01); *B41J 2/17509* (2013.01); *B41J 2/17523* (2013.01); *B41J 2/17553* (2013.01); *B41J 2/17566* (2013.01); *B41J 29/02* (2013.01); *B41J 29/13* (2013.01)

(58) Field of Classification Search

CPC ..... B41J 2/17596; B41J 2/17523; B41J 2/17503; B41J 2/17563; B41J 2/17566; B41J 2/17593; B41J 2/18

See application file for complete search history.

(56) References Cited

U.S. PATENT DOCUMENTS 7,008,051 B2 3/2006 Akermalm

FOREIGN PATENT DOCUMENTS

JP 2012-152996 A 8/2012

*Primary Examiner* — Kristal Feggins

(57) ABSTRACT

There is provided a frame which holds a recording section, a support unit which is provided on the outer side of the frame and which supports liquid containers which contain the liquid which is to be ejected from the recording section, liquid supply tubes which supply the liquid which is contained in the liquid containers to the recording section, and a pump which is arranged in the support unit and which sends the liquid which is contained in the liquid containers to the recording section via the liquid supply tubes.

11 Claims, 12 Drawing Sheets

RECORDING APPARATUS

TECHNICAL FIELD

The present invention relates to a recording apparatus which performs recording by ejecting a liquid from a recording section.

PRIOR ART

PTL 1 discloses a recording apparatus where a case, which contains an ink pack (a liquid container) which is formed from a flexible material, is mounted on the outer side of a casing body which contains a recording section. In the recording apparatus, ink (liquid) which is contained in an inner section of an ink tank is supplied to the recording section which is inside the casing body via an ink supply tube and printing (recording) is performed by ejecting the ink which is supplied from the recording section onto a medium such as paper.

CITATION LIST

Patent Literature

PTL 1: U.S. Pat. No. 7,008,051

SUMMARY OF THE INVENTION

Problems to be Solved by the Invention

However, since the ink supply tube is guided from the ink pack which is provided at an outer section of the casing body to the recording section which is provided in an inner section of the casing body and the length of the ink supply tube is long in this recording apparatus, the flow resistance of the ink which flows inside the ink supply tube increases and it becomes difficult for ink to flow through the ink supply tube. In addition, the ink pack is sealed off and the inner sections of the ink pack are not open to air. For this reason, a pump for sending ink from the ink pack to the recording section is provided in an inner section of the casing body in the recording apparatus described above. Here, in a case where a pump is not provided, it is necessary to provide the ink tank at a position which is higher than the recording section in order for the ink to be sent to the recording section using the water head difference. For this reason, there are limits to the design of the recording apparatus.

The pump is provided in an inner section of the casing body in the recording apparatus described above, but in this case, it is necessary for the casing body to be opened up so that it is possible to gain access to inner sections of the casing body in order to perform maintenance on the pump.

A space is necessary for removing a cover which configures the casing body and placing the cover in the vicinity of the recording apparatus or the like when the casing body is opened up. For this reason, there is a problem in that a wider operation area is necessary when maintenance is performed on a pump.

Here, these problems are not limited to recording apparatuses which eject ink from a recording section but these problems are generally shared by recording apparatuses where a liquid is supplied from a liquid container, which contains the liquid which is to be ejected from a recording section, to the recording section via a liquid supply tube.

The present invention takes these problems into consideration and the purpose of the present invention is to propose a recording apparatus where it is possible to easily perform maintenance on a pump which sends a liquid which is contained in a liquid container to a recording section.

Means to Solve the Problems

A recording apparatus for solving the problems described above is provided with a recording section which performs recording by ejecting a liquid onto a recording medium, a frame which holds the recording section, a support unit which is provided on the outer side of the frame and which supports a liquid container which contains the liquid which is to be ejected from the recording section, a liquid supply tube which supplies the liquid which is contained in the liquid container to the recording section, and a pump which is arranged in the support unit and which sends the liquid which is contained in the liquid container to the recording section via the liquid supply tube.

Since the pump is provided in the support unit which is provided on an outer section of the casing body in the configuration described above, it is not necessary for the casing body to be opened up when maintenance is carried out on the pump. For this reason, it is not necessary for a cover which covers the casing body to be removed and it is possible to suppress enlargement of the operation area for performing maintenance on the pump.

Here, the support unit may be provided so as to be freely attached and detached with regard to the frame. In addition, a cover which covers the frame may be provided and the support unit may be provided to be freely attached and detached with regard to the cover.

In addition, in the recording apparatus described above, it is desirable for a case which contains the liquid container to be provided and for the support unit to be provided in the case.

It is possible for the liquid container to be protected using the case in the configuration described above.

In addition, in one aspect of the recording apparatus, the pump is attached to a portion which is positioned between the casing body and the case. It is possible to perform maintenance on the pump in the configuration described above by removing the case from the casing body without the casing body needing to be opened up. For this reason, maintenance on the pump is easy. In addition, in this configuration, if a recess section is provided in the outer surface of the case and the pump is contained in the recess section, it is no longer necessary to provide space for containing the pump by the gap between the case and the casing body being widened. Accordingly, it is possible to attach the pump to the case while also suppressing the recording apparatus from increasing in size.

In addition, in one aspect of the recording apparatus, the pump is contained in the case. Since it is possible to carry out maintenance on the pump which is contained in the case by opening up the case in the configuration described above, it is not necessary for the case to be removed from the casing body. For this reason, it is possible for maintenance to be even easier.

In addition, in the recording apparatus described above, it is desirable for the liquid container to contain the liquid which is to be supplied to the recording section in a bag which is formed from a flexible material, for a hanging mechanism which is attached in a state so that the liquid container hangs down to be fixed to an inner surface of the case, and for the pump to be attached to the inner surface so as to be positioned above the center of the liquid container in the up and down direction in a state where the liquid container is attached to the hanging mechanism.

Since the liquid container is the form of a bag which is formed from a flexible material, the liquid which is contained in an inner section gathers at the bottom portion due to gravity and the bottom portion takes on a bulging shape compared to the top portion in a state of hanging down from the hanging mechanism.

Since the pump is provided on the inner surface so as to be positioned above the center of the liquid container in the up and down direction in the configuration described above, the pump is contained inside the case at a position where there is less bulging of the liquid container. For this reason, it is possible for the pump to be contained in the case without the case increasing in size.

In addition, in the recording apparatus described above, it is desirable for the pump to be attached at a position which is shifted from the center of the liquid container in the left and right direction in a state where the liquid container is attached to the hanging mechanism.

When the liquid which is contained in an inner section of the liquid container which is in the form of a bag is suctioned out, the liquid container droops from the top toward the bottom. In addition, the liquid container also droops from both ends towards the center in the left and right direction.

Since the pump is provided at a position which is shifted from the center of the liquid container in the left and right direction in the configuration described above, the pump is positioned at a portion where it is easy for the liquid container to droop when the recording apparatus is being used. For this reason, it is possible to further suppress interference between the pump and the liquid container.

In addition, a recording apparatus for solving the problems described above is provided with a recording section which performs recording by ejecting a liquid onto a recording medium, a frame which holds the recording section, a support unit which is mounted on the outer side of the frame so to be able to be attached and detached and which supports a liquid container which contains the liquid which is to be ejected from the recording section, a liquid supply tube which supplies the liquid which is contained in the liquid container to the recording section, and a pump which is attached to the frame, is positioned between the support unit and the frame when the support unit is mounted on the frame, and which sends the liquid which is contained in the liquid container to the recording section via the liquid supply tube.

Since the pump is provided between the support unit and the frame when the support unit is mounted on the frame in the configuration described above, it is not necessary to gain access to inner sections of the frame when maintenance is carried out on the pump. For this reason, it is possible to easily perform maintenance on the pump which sends the liquid which is contained in the liquid container to the liquid supply tube.

In addition, in the recording apparatus described above, it is desirable for a case which contains the liquid container to be provided and for the support unit to be provided in the case.

It is possible for the liquid container to be protected using the case in the configuration described above.

In addition, it is desirable for the pump to be contained in a recess section which is provided in the outer surface of the case of the recording apparatus described above.

Since it is no longer necessary to provide space for containing the pump between the case and the casing body in the configuration described above, it is possible to attach the pump to the case while also suppressing the recording apparatus from increasing in size.

In addition, in the recording apparatus described above, the liquid container contains the liquid which is to be supplied to the recording section in a bag which is formed from a flexible material, a hanging mechanism to which the liquid container in a state of hanging down is attached to is fixed to an inner surface of the case, and a location which corresponds to the recess section and which protrudes from the inner surface of the case is attached to the inner surface so as to be positioned above the center of the liquid container in the up and down direction in a state where the liquid container is attached to the hanging mechanism.

Since the liquid container is the form of a bag which is formed from a flexible material, the liquid which is contained in an inner section gathers at the bottom portion due to gravity and the bottom portion takes on a bulging shape compared to the top portion in a state of hanging down from the hanging mechanism.

Since the pump is provided on the inner surface so as to be positioned above the center of the liquid container in the up and down direction in the configuration described above, the pump is contained inside the case at a position where there is less bulging of the liquid container. For this reason, it is possible for the pump to be contained in the case without the case increasing in size.

In addition, in the recording apparatus described above, a location which corresponds to the recess section and which protrudes from the inner surface of the case is attached at a position which is shifted from the center of the liquid container in the left and right direction in a state where the liquid container is attached to the hanging mechanism.

When the liquid which is contained in an inner section of the liquid container which is in the form of a bag is suctioned out, the liquid container droops from the top toward the bottom. In addition, the liquid container also droops from both ends towards the center in the left and right direction.

Since the pump is provided at a position which is shifted from the center of the liquid container in the left and right direction in the configuration described above, the pump is positioned at a portion where it is easy for the liquid container to droop when the recording apparatus is being used. For this reason, it is possible to further suppress interference between the pump and the liquid container.

In addition, in the recording apparatus described above, it is desirable for the support unit to be provided with a plurality of hanging mechanisms to which the liquid containers in a state of hanging down are attached, for the pump to be a diaphragm pump which has diaphragms which are provided in liquid supply paths from the liquid containers to the recording head and which suctions up the liquid which is contained in the liquid containers and supplies the liquid to the recording section due to the diaphragms being bent using an actuator, for as many of the diaphragms to be provided as the number of the hanging mechanisms, and for one actuator which is connected to each of the diaphragms to be provided.

Since there is one actuator which operates each of the diaphragms in the configuration described above, it is possible to achieve a reduction in the number of components.

BRIEF DESCRIPTION OF THE DRAWINGS

FIG. 6A is a diagram illustrating a state when ink is filled into the inside of the ink end sensor, FIG. 6B is a diagram illustrating an intermediate state where ink is discharged from the ink end sensor, and FIG. 6C is a diagram illustrating a state where the remaining amount of ink inside the ink end sensor is equal to or less than a specific amount.

DESCRIPTION OF THE EMBODIMENTS

One embodiment of a recording apparatus will be described below with reference to FIG. 1 to FIG. 9. Here, the present embodiment is illustrated with an ink jet printer (referred to below simply as the "printer") given as an embodiment of a recording apparatus.

Figure 1:
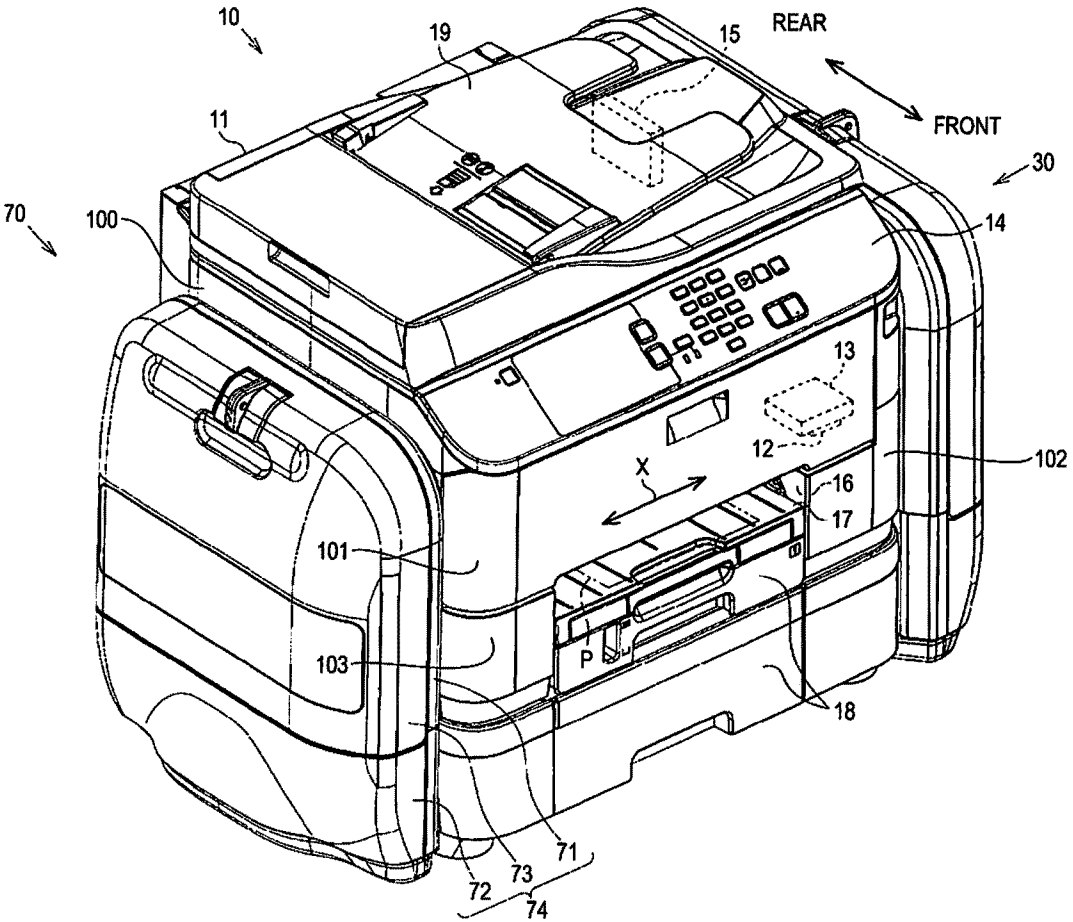
FIG. 1 is a perspective diagram illustrating a recording apparatus as one embodiment of the present invention.

As shown in FIG. 1, the printer is provided with a recording unit 10 which performs recording on paper P which is one example of a recording medium by ejecting ink which is one example of a liquid and two liquid container units 30 and 70 which supply ink to the recording unit 10. Here, the liquid container units 30 and 70 are container units which contain liquid containers 20 which will be described later.

A casing body 11 is provided for the recording unit 10, and a recording head 12 which performs recording on the paper P by ejecting ink and a carriage 13 which supports the recording head 12 are contained in the casing body 11.

The carriage 13 is able to move back and forth in an inner section of the casing body 11 in a scanning direction X which is also the width direction of the printer, and recording (printing) is performed on the paper P by ink being ejected while the recording head 12 moves back and forth in the width direction of the printer in accompaniment with movement of the carriage 13. That is, a recording section is configured using the recording head 12, the carriage 13, and the like.

In addition, the casing body 11 is provided with an operating panel 14 for a user to operate the printer. Here, as shown by the arrows in FIG. 1, the direction which is toward the notation for a monitor and buttons and the like in the operating panel 14 is set below as the front of the printer and the opposite direction to the front is set below as the rear of the printer. A control substrate 15 for executing various types of control based on signals from the operating panel 14 is contained in the casing body 11.

A rectangular paper discharge opening 16 where the paper P which is recorded upon in an inner section of the casing body 11 is discharged to an outer section of the casing body 11 is provided in the front surface of the casing body 11 which is positioned on the front side of the printer. The paper P which is discharged from the paper discharge opening 16 is placed onto a paper discharge tray 17. In addition, a paper supply cassette 18 with upper and lower levels is mounted on the front surface of the casing body 11 below the paper discharge tray 17 so as to be freely attached and detached. It is possible for a plurality of sheets of the paper P to be contained in the paper supply cassette 18 in a state of being stacked.

In addition, a scanner section 19, which contains a scanner which reads images which are recorded on an original document which is set in a specific reading position, is provided on an upper section of the casing body 11 in the recording unit 10

Next, the liquid containers 20 which are contained in the liquid container units 30 and 70 will be described with reference to FIG. 2.

Figure 2:
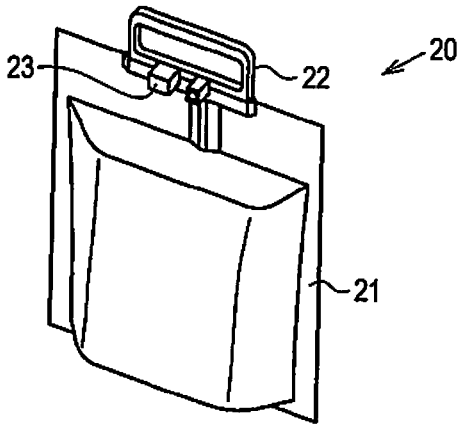
FIG. 2 is a perspective diagram schematically illustrating a liquid container which is used in the recording apparatus.

As shown in FIG. 2, the liquid container 20 has an ink pack 21 which is a bag which is formed from a flexible material and which is sealed, and the ink pack 21 contains ink. A handle section 22 with a rectangular frame shape is fixed to an upper end section of the ink pack 21. An IC chip 23 is provided at the connection section between the ink pack 21 and the handle section 22. Information on the ink which is contained in the ink pack 21 such as the type of ink and the remaining amount of ink is stored in the IC chip 23.

Next, the first liquid container unit 30 which is attached to the right side surface of the casing body 11 will be described with reference to FIG. 3 to FIG. 5.

Figure 3:
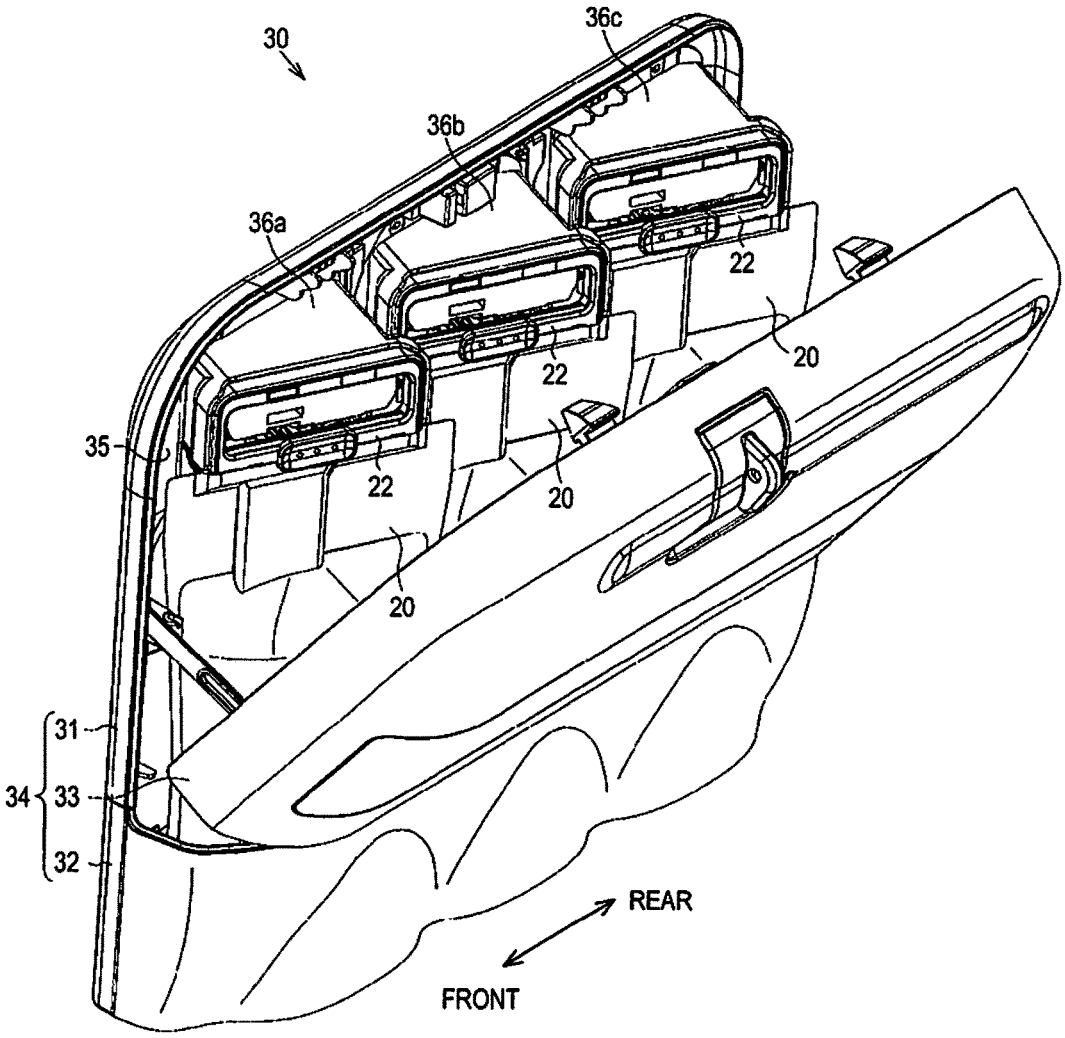
FIG. 3 is a perspective diagram illustrating a first liquid container unit in a state where a lid is open.

As shown in FIG. 3, the first liquid container unit 30 is provided with a side wall forming member 31 which is mounted on the right side surface of the casing body 11 so as to be able to be attached and detached. A bottom forming member 32 with a bottomed box shape is coupled with a lower end of the side wall forming member 31. In addition, a lid 33 is coupled with an upper end of the bottom forming member 32 so as to be able to rotate. The side wall forming member 31 and the lid 33 abut with and separate from each other due to rotating of the lid 33. A case 34 with a cuboid shape is configured for the first liquid container unit 30 using the side wall forming member 31, the bottom forming member 32, and the lid 33.

A plurality of the liquid containers 20 are contained inside the case 34. A plurality of stays 36*a*, 36*b*, and 36*c* are fixed to a wall surface 35 of the side wall forming member 31 on the inner side of the case 34. The liquid containers 20 hang down from the stays 36*a*, 36*b*, and 36*c* so as to be able to be attached and detached due to fastening of the handle sections 22 of the liquid containers 20. That is, the stays 36*a*, 36*b*, and 36*c* function as hanging mechanisms. In addition, the liquid containers 20 are supported by inner sections of the case 34 due to the liquid containers 20 hanging down from the stays 36*a*, 36*b*, and 36*c* which are provided in the case 34 in this manner. That is, a support unit which supports the liquid containers 20 is configured using the stays 36*a*, 36*b*, and 36*c* and the side wall forming member 31. Then, the support unit is provided in the case 34 and the support unit is freely attached and detached with regard to the casing body 11. Here, for example, yellow ink, magenta ink, and cyan ink are contained in the liquid containers 20 in this order from the front side of the printer in the depth direction.

Figure 4:
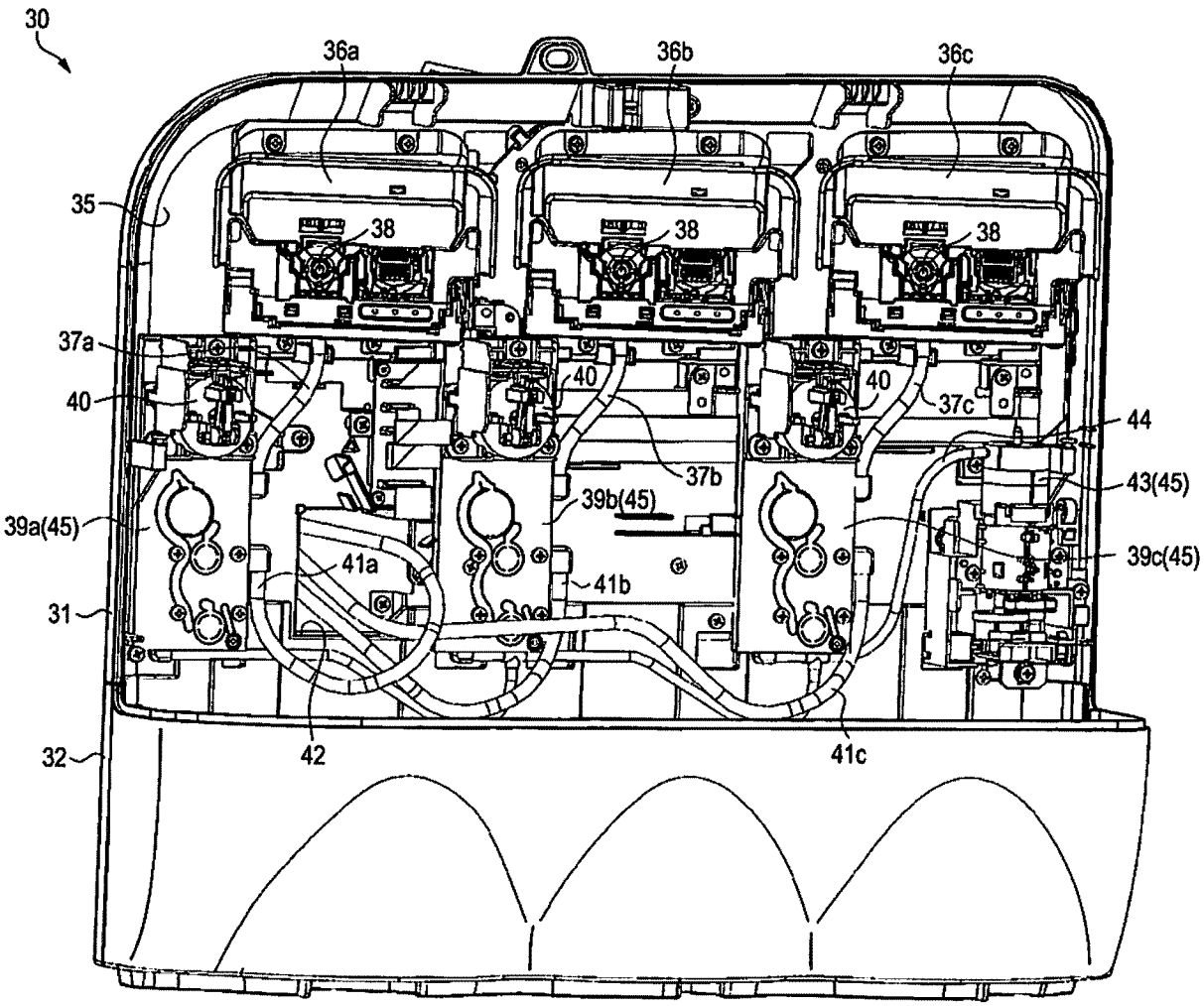
FIG. 4 is a perspective diagram of the first liquid container unit in a state where a lid and a cover are removed.

As shown in FIG. 4, ink supply tubes 37*a*, 37*b*, and 37*c* are respectively connected to the stays 36*a*, 36*b*, and 36*c* from below. One end of each of the ink supply tubes 37*a*, 37*b*, and 37*c* are connected to liquid supply needles 38 which are provided in inner sections of each of the stays 36*a*, 36*b*, and 36*c*. The tip ends of the liquid supply needles 38 are exposed and the liquid supply needles 38 are inserted into inner sections of the liquid containers 20 when the liquid containers 20 are hanging down from each of the stays 36*a*, 36*b*, and 36*c*. Due to this, the ink supply tubes 37*a*, 37*b*, and 37*c* which are connected to the liquid supply needles 38 communicate with the liquid container 20.

The other end of the ink supply tube 37*a* which is connected to the stay 36*a* is connected to a diaphragm containing section 39*a* which has a diaphragm and is fixed to the wall surface 35 of the side wall forming member 31. In addition, the ink supply tube 37*b* which is connected to the stay 36*b* is connected to a diaphragm containing section 39*b* which has a diaphragm and is fixed to the wall surface 35 of the side wall forming member 31. In addition, the ink supply tube 37*c* which is connected to the stay 36*c* is connected to a diaphragm containing section 39*c* which has a diaphragm and is fixed to the wall surface 35 of the side wall forming member 31. Each of the diaphragm containing sections 39*a*, 39*b*, and 39*c* are provided with an ink chamber and an air chamber which are partitioned by the diaphragm. The ink chambers are in a state of communicating with inner sections of the liquid containers 20 via the ink supply tubes 37*a*, 37*b*, and 37*c* when the liquid containers 20 are attached to the stays 36*a*, 36*b*, and 36*c*.

In addition, ink end sensors 40 are connected to the diaphragm containing sections 39*a*, 39*b*, and 39*c*. For this reason, the ink which passes through the ink chambers of the diaphragm containing sections 39*a*, 39*b*, and 39*c* flows into the ink end sensors 40. Flow paths which are formed inside the diaphragm containing sections 39*a*, 39*b*, and 39*c* are respectively connected to the ink end sensors 40, and ink supply tubes 41*a*, 41*b*, and 41*c* are connected to the flow paths. The ink supply tubes 41*a*, 41*b*, and 41*c* are guided around the outside of the case 34 via tube insertion holes 42 which are provided in the side wall forming member 31. Then, the ink supply tubes 41*a*, 41*b*, and 41*c* which are guided around the outside of the case 34 are introduced into an inner section of the casing body 11 of the recording unit 10 and are connected to the recording head 12.

In addition, one motor 43 is fixed below the stay 36*c* on the wall surface 35 of the side wall forming member 31. One end of an air supply and discharge tube 44 is connected to the motor 43. The air supply and discharge tube 44 branches out into three and each of the end sections of the air supply and discharge tube 44 which branches out are respectively connected to the air chambers of the diaphragm containing sections 39*a*, 39*b*, and 39*c*. The motor 43 suctions out air from each of the air chambers of the diaphragm containing sections 39*a*, 39*b*, and 39*c* via the air supply and discharge tube 44 and air is released from each of the air chambers.

For this reason, when air is suctioned out from each of the air chambers of the diaphragm containing sections 39*a*, 39*b*, and 39*c* due to the motor 43 being operated, the pressure in the air chambers become lower than the pressure in the ink chambers and the diaphragms bend towards the air chamber side so that the volume of the ink chambers expand. Due to this, ink is suctioned up from the liquid containers 20 into the ink chambers via the ink supply tubes 37*a*, 37*b*, and 37*c*. On the other hand, when air is released from each of the air chambers, the diaphragms which are bent towards the air chamber side bend back the other way and the volume of the ink chambers contracts. Due to this, ink is pushed out from inside of the ink chambers and ink is supplied to the recording head 12 via the ink end sensors 40. Here, check valves which prevent back flow of ink are attached to inlet sections where ink flows into the ink chambers and outlet sections where ink is discharged from the ink chambers. For this reason, when ink is suctioned from the liquid container 20 using the diaphragm containing sections 39*a*, 39*b*, and 39*c* and the motor 43, the ink which is suctioned is supplied to the recording head 12 via the ink end sensors 40 and the ink supply tubes 41*a*, 41*b*, and 41*c*. In this manner, a diaphragm pump 45 is configured such that the motor 43 functions as an actuator which bends the diaphragms and ink which is contained in the liquid containers 20 is sent to the recording head 12 using the diaphragm containing sections 39*a*, 39*b*, and 39*c* and the motor 43.

Figure 5:
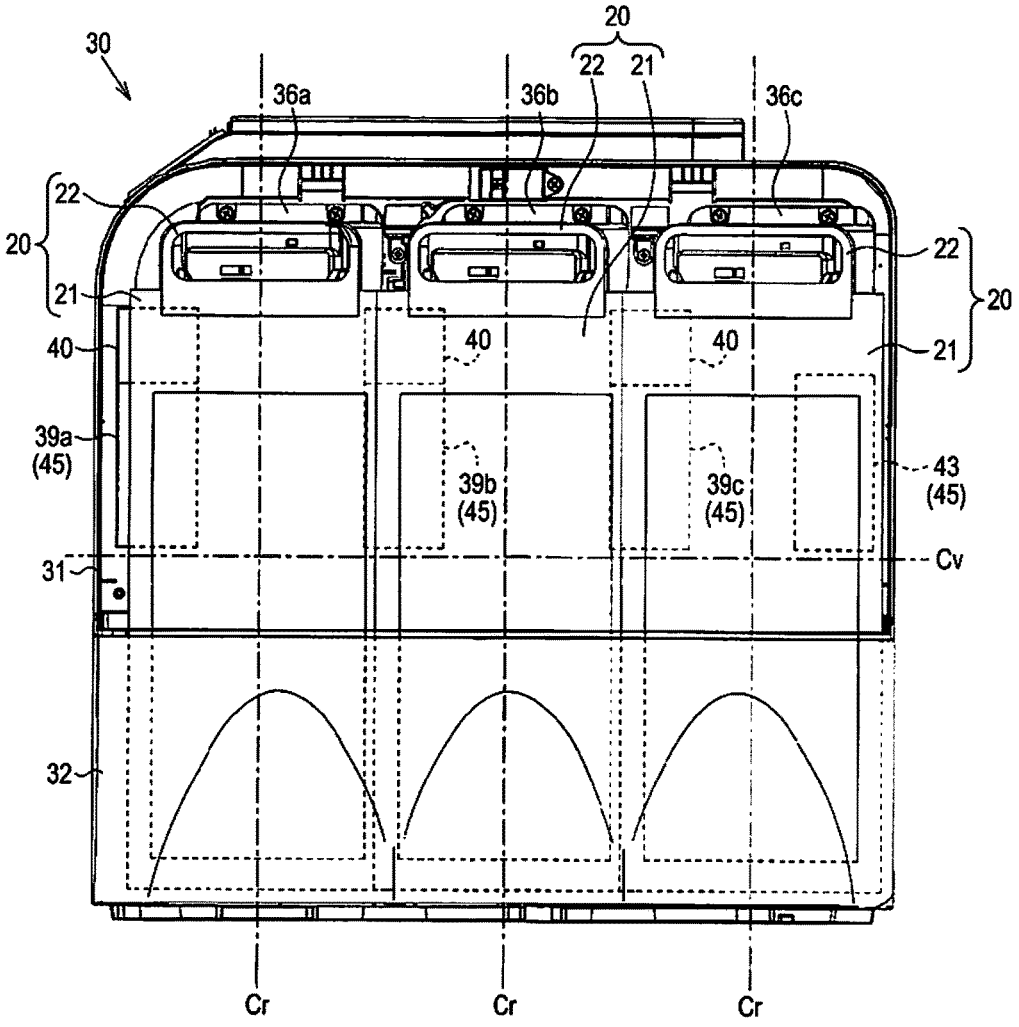
FIG. 5 is a side surface diagram of the first liquid container unit where a liquid container is attached.

Here, as shown in FIG. 5, the diaphragm containing sections 39*a*, 39*b*, and 39*c* and the motor 43 are attached to positions above a center Cv of the liquid containers 20 in the up and down direction when the case 34 is viewed from the side surface in a state where the liquid containers 20 are attached to the stays 36*a*, 36*b*, and 36*c*. In addition, the diaphragm containing sections 39*a*, 39*b*, and 39*c* and the motor 43 are attached to positions which are shifted from a center Cr of each of the liquid containers 20 in the left and right direction. That is, the pump 45 is contained in the case 34, and the pump 45 is positioned above the center Cv of the liquid containers 20 in the up and down direction and is attached to a position which is shifted from the center Cr of the liquid containers 20 in the left and right direction in a state where the liquid containers 20 are attached to the stays 36*a*, 36*b*, and 36*c* in the case 34.

In addition, the ink end sensors 40 are also positioned above the center Cv of the liquid containers 20 in the up and down direction and are attached to a position which is shifted from the center Cr of the liquid containers 20 in the left and right direction in a state where the liquid containers 20 are attached to the stays 36*a*, 36*b*, and 36*c* of the case 34.

Figure 6C:
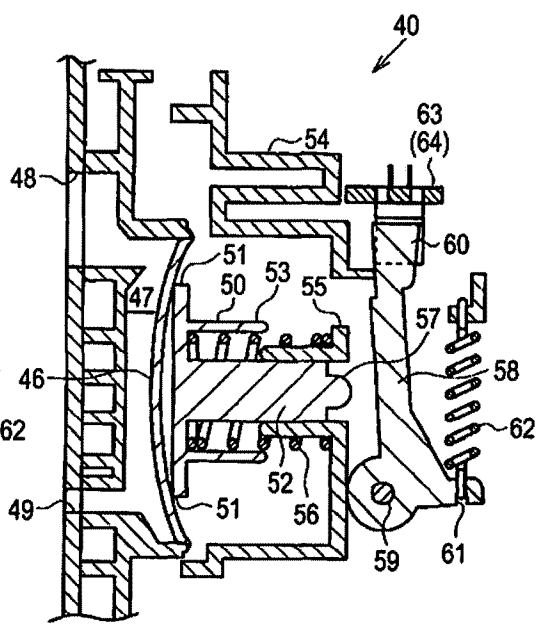
FIGS. 6A to 6C are cross sectional diagrams illustrating an operation format for an ink end sensor which is provided in the first liquid container unit.
Figure 6B:
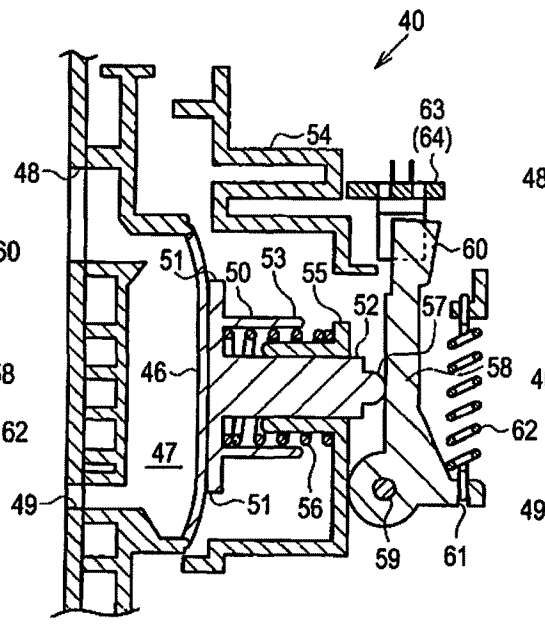

Next, the ink end sensors 40 will be described with reference to FIGS. 6A to 6C.

Figure 6A:
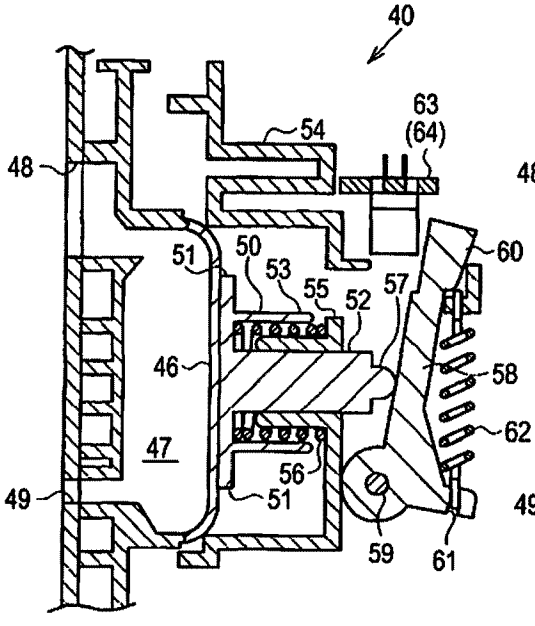

As shown in FIG. 6A, buffer chambers 47 which are segmented using flexible films 46 are provided in the ink end sensors 40. The buffer chambers 47 are provided with ink flow inlets 48 which are respectively connected to the ink chambers of the diaphragm containing sections 39*a*, 39*b*, and 39*c* and ink flow outlets 49 which are respectively connected to the ink supply tubes 41*a*, 41*b*, and 41*c* via the flow paths of the diaphragm containing sections 39*a*, 39*b*, and 39*c*.

Pistons 50 are provided on the opposite sides to the buffer chambers 47 so as to interpose the films 46. The piston 50 is provided with abutting sections 51 with substantially a disk shape which abuts the films 46. Shaft sections 52 with a cylindrical shape which extend perpendicularly from the abutting sections 51 are provided at central positions of the abutting sections 51. In addition, the abutting sections 51 are also provided with cylindrical sections 53 which protrude so as to encompass the surroundings of the shaft sections 52. Housings 54 for the ink end sensors 40 are provided with support sections 55 which support the shaft sections 52 so that the shaft sections 52 are able to slide in the shaft direction of the shaft sections 52 (the left and right direction in FIGS. 6A to 6C). Compression springs 56 are provided between the support sections 55 and the abutting sections 51. The compression springs 56 are positioned between the shaft sections 52 and the cylinder sections 53 and press the pistons toward the film 46 side.

In addition, head sections 57 with semi-spherical shapes are formed at tip ends of the shaft sections 52 of the pistons 50. Levers 58 abut with the head sections 57. Rotation shafts 59 pass through one end section of the levers 58. The levers 58 are supported by the rotation shafts 59 so as to be able to rotate. Shield sections 60 with substantially rectangular shapes are provided at the other end sections of the levers 58 and the levers 58 change the position of the shield sections 60 by rotating.

In addition, notch sections 61 are provided at one end section of the levers 58. Tension springs 62 which are supported by the housings 54 are attached to the notch sections 61. For this reason, in the levers 58, an upward pulling force acts on the notch section 61, that is, a force acts so as to move the shield sections 60 in a counter clockwise manner centered on the rotation shaft 59.

In addition, the ink end sensors 40 are provided with photo interrupters 64 which have a light receiving section 63 and a light emitting section which are provided to oppose each other. Specific gaps are provided between the light receiving sections 63 and the light emitting sections, and the shield sections 60 are inserted into the gaps when the levers 58 are rotated. The photo interrupters 64 block off light which is emitted from the light emitting sections using the shield sections 60 and signals are transmitted to the control substrate 15 when it is no longer possible for the light receiving section 63 to detect light. Here, only the light receiving sections 63 of the photo interrupters 64 are shown in FIGS. 6A to 6C.

Next, the operation format for the ink end sensor 40 will be described.

When ink is supplied to the recording head 12 by the ink being suctioned up using the pump 45, the buffer chamber 47 of the end ink sensor 40 which is in the flow path of the ink towards the recording head 12 is in a state of being filled by ink. For this reason, the film 46 is in a state of bending to the piston 50 side as shown in FIG. 6A. In this state, the piston 50 moves in the right direction against the pressing force of the compression spring 56 due to being pressured by the film 46 and the head section 57 of the piston 50 is in a state of pushing the lever 58. Due to this, the lever 58 rotates in a clockwise manner against the pressing force of the tension spring 62 and the lever 58 is in a state of abutting with the housings 54 which supports the tension spring 62. As a result, it is possible for light which is emitted from the light emitting section to be detected using the light receiving section 63 without the shield section 60 of the lever 58 being inserted into the photo interrupter 64, and a signal is not transmitted from the photo interrupter 64 to the control substrate 15.

On the other hand, when ink is ejected from the recording head 12 due to the recording head 12 being driven, the ink inside the buffer chamber 47 is reduced. For this reason, as shown in FIG. 6B, the amount by which the film 46 bends to the piston 50 side is reduced and the piston 50 gradually moves to the left side in FIGS. 6A to 6C due to being pressured using the pressing force of the compression spring 56. Then, when the piston 50 moved to the left side, the lever 58, which is being pushed using the head section 57 of the piston 50 rotates in a counter clockwise manner due to the pressing force of the tension spring 62 and the shield section 60 moves to the left. Then, when the ink inside the buffer chamber 47 reaches a specific amount or less, the piston 50 moves further to the left side due to the pressing force of the compression spring 56 and the shield section 60 abuts with the housing 54 due to the lever 58 rotating in a counter clockwise manner as shown in FIG. 6C. Due to this, the lever 58 is maintained in a state of being inserted between the light receiving section 63 and the light emitting section in the photo interrupter 64, and light is no longer detected by the light receiving section 63. As a result, a signal is transmitted from the photo interrupter 64 to the control substrate 15.

When this signal is received in the printer, ink is suctioned up from the liquid container 20 and supplied to the recording head 12 due to the motor 43 being driven. Due to this, ink is again filled into the buffer chamber 47. However, when the remaining amount of ink which is contained in the liquid container 20 becomes low, it is no longer possible for a sufficient amount of ink to be supplied to the buffer section 47 even when the motor 43 is being driven and the signal from the ink end sensor 40 is continuously transmitted. For this reason, it is determined in the control substrate 15 that the liquid container 20 is empty and a replacement sign is output in a case where the signal continues for a specific period of time or more even when the motor 43 is being driven.

Next, a second liquid container unit 70 which is attached to the left side surface of the casing body 11 will be described with reference to FIG. 1, FIG. 7, and FIG. 8.

Figure 7:
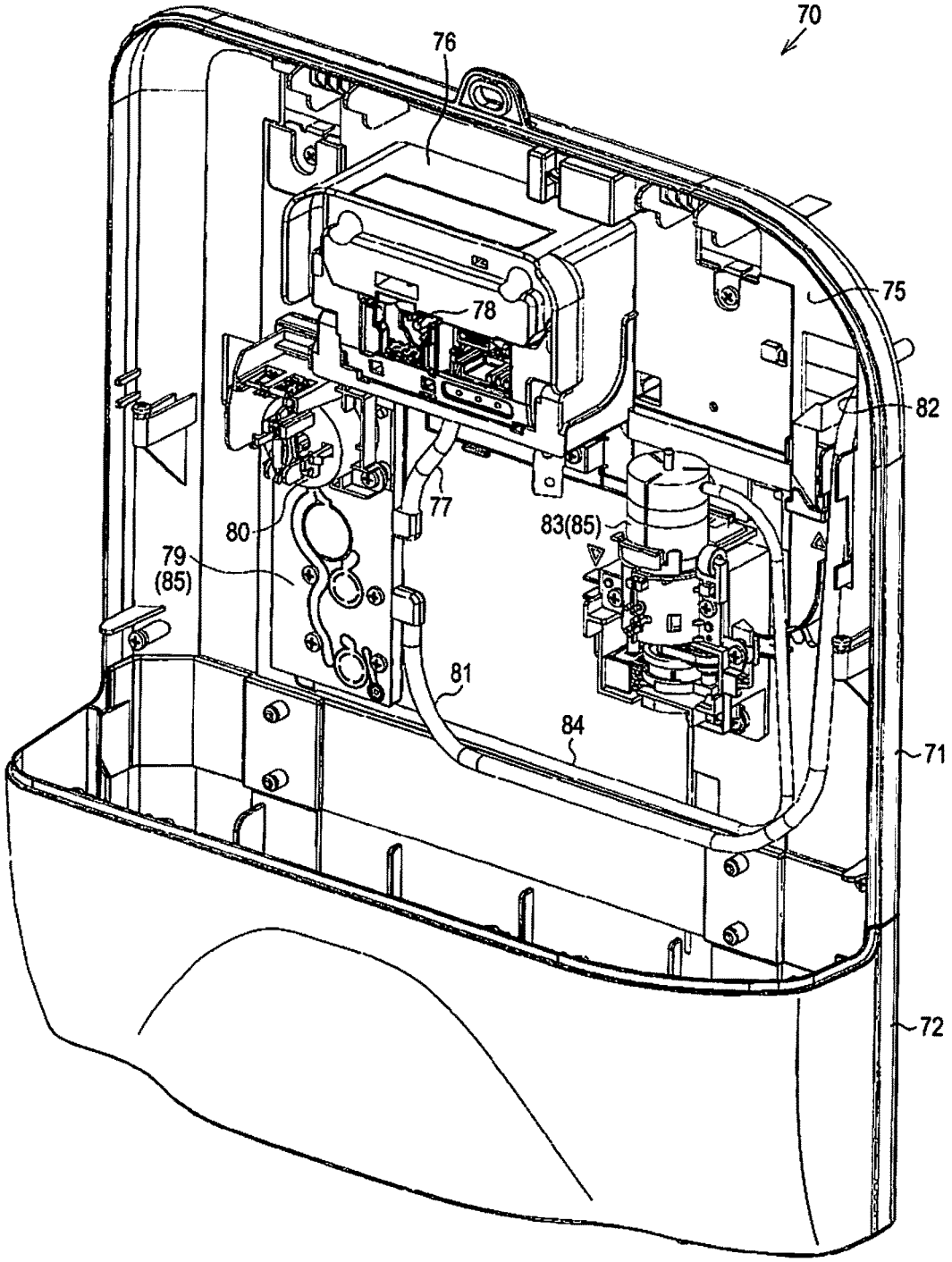
FIG. 7 is a perspective diagram of a second liquid container unit in a state where a lid and a cover are removed.

As shown in FIG. 1 and FIG. 7, the second light container unit 70 is provided with a side wall forming member 71 which is mounted to the left side surface of the casing body 11 so as to be able to be attached and detached. A bottom forming member 72 with a bottomed box shape is coupled with a lower end of the side wall forming member 71. In addition, a lid 73 is coupled with an upper end of the bottom forming member 72 so as to be able to rotate. The side wall forming member 71 and the lid 73 abut with and separate from each other due to rotating of the lid 33. A case 74 with a cuboid shape for the second liquid container unit 70 is configured using the side wall forming member 71, the bottom forming member 72, and the lid 73.

One liquid container 20 is contained inside the case 74. The liquid container 20 is provided with the ink pack 21 which is a bag which contains, for example, black ink and which is formed from a flexible material with a larger capacity than the liquid containers 20 which are provided in the first liquid container unit 30 and the handle section 22 with a rectangular frame shape which is fixed to an upper end section of the ink pack 21.

One stay 76 is fixed to a wall surface 75 of the side wall forming member 71 on the inner side of the case 74. The liquid container 20 hangs down from the stay 76 so as to be able to be attached and detached due to the handle section 22 of the liquid container 20 being fastened. That is, the stay 76 functions as the hanging mechanism. In addition, the liquid container 20 is supported by an inner section of the case 74 due to the liquid container 20 hanging down from the stay 76 which is provided in the case in this manner. That is, a support unit which supports the liquid container 20 is configured using the stay 76 and the side wall forming member 71. Then, the support unit is provided in the case 74 and the support unit is freely attached and detached with regard to the casing body 11.

As shown in FIG. 7, an ink supply tube 77 is connected to the stay 76 from below. One end of the ink supply tubes 77 is connected to a liquid supply needle 78 which is provided in an inner section of the stay 76. The tip end of the liquid supply needle 78 is exposed and the liquid supply needle 38 is inserted into an inner section of the liquid container 20 when the liquid container 20 is hanging down from the stay 76. Due to this, the ink supply tube 77 which is connected to the liquid supply needle 78 communicates with the liquid container 20.

The other end of the ink supply tube 77 is connected to a diaphragm containing section 79 which has a diaphragm and is fixed to the wall surface 75 of the side wall forming member 71. The diaphragm containing section 79 is provided with an ink chamber and an air chamber which are partitioned by the diaphragm. The ink chamber is in a state of communicating with an inner section of the liquid container 20 via the ink supply tube 77 when the liquid container 20 is attached to the stay 76.

In addition, an ink end sensor 80 is connected to the diaphragm containing section 79. For this reason, the ink which passes through the ink chamber of the diaphragm containing sections 79 flows into the ink end sensor 80. A flow path which is formed inside the diaphragm containing section 79 is connected to the ink end sensor 80, and an ink supply tube 81 is connected to the flow path. The ink supply tube 81 is wound around the outside of the case 74 via a tube insertion hole 82 which is provided in the side wall forming member 71. Then, the ink supply tube 81 which is wound around the outside of the case 34 is introduced into an inner section of the casing body 11 of the recording unit 10 and is connected to the recording head 12.

In addition, a motor 83 is fixed on the wall surface 75 of the side wall forming member 71. One end of an air supply and discharge tube 84 is connected to the motor 83. The other end of the air supply and discharge tube 84 is connected to the air chamber of the diaphragm containing sections 79. The motor 83 suctions out air from inside the air chamber via the air supply and discharge tube 84 and the air chamber releases air.

For this reason, when air is suctioned out from the air chamber of the diaphragm containing section 79 due to the motor 83 being operated, the pressure in the air chamber becomes lower than the pressure in the ink chamber and the diaphragm bends towards the air chamber side so that the volume of the ink chamber expands. Due to this, ink is suctioned up from the liquid container 20 into the ink chamber via the ink supply tube 77. On the other hand, when the air chamber releases air, the diaphragm which is bent towards the air chamber side bends back the other way and the volume of the ink chamber contracts. Due to this, ink is pushed out from inside of the ink chamber and ink is supplied to the recording head 12 via the ink end sensor 80. Here, a check valve which prevents back flow of ink is attached to an inlet section where ink flows into the ink chamber and an outlet section where ink flows out from the ink chamber. For this reason, when ink is suctioned from the liquid container 20 using the diaphragm containing section 79 and the motor 83, the ink which is suctioned is supplied to the recording head 12 via the ink end sensor 80 and the ink supply tube 81. In this manner, a diaphragm pump 85 is configured such that the motor 83 functions as an actuator which bends the diaphragms and ink which is contained in the liquid container 20 is sent to the recording head 12 using the diaphragm containing section 79 and the motor 83.

Figure 8:
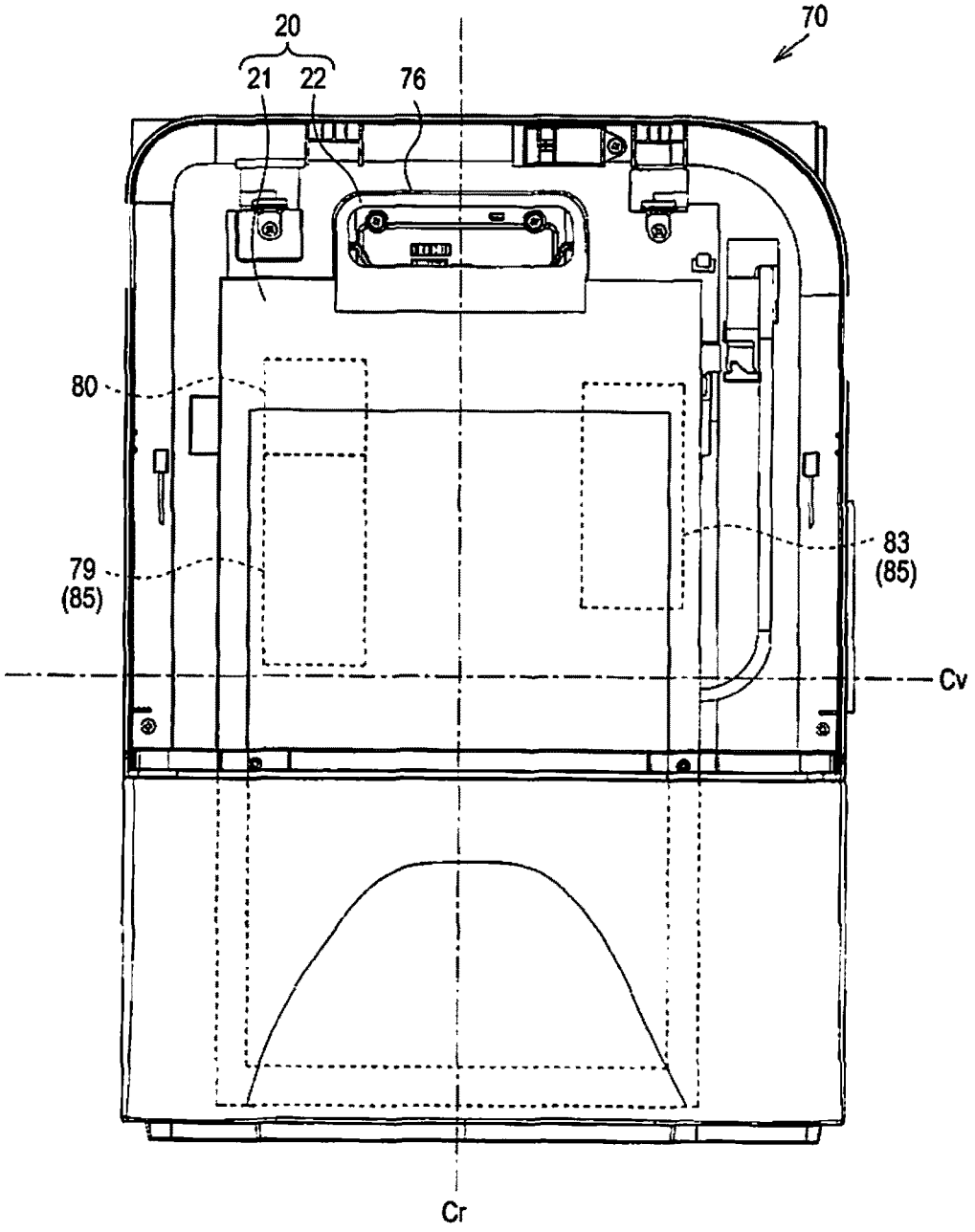
FIG. 8 is a side surface diagram of the second liquid container unit where a liquid container is attached.

Here, as shown in FIG. 8, the diaphragm containing section 79 and the motor 83 are positioned above the center Cv of the liquid container 20 in the up and down direction and are attached to positions which are shifted from the center Cr of the liquid container 20 in the left and right direction when the case 74 is viewed from the side surface in a state where the liquid container 20 is attached to the stay 76.

That is, the pump 85 is contained in the case 74, and is positioned above the center Cv of the liquid containers 20 in the up and down direction and is attached to a position which is shifted from the center Cr of the liquid containers 20 in the left and right direction in a state where the liquid container 20 is attached to the stay 76 of the case 74.

In addition, the ink end sensor 80 is also positioned above the center Cv of the liquid container 20 in the up and down direction and is attached to a position which is shifted from the center Cr of the liquid container 20 in the left and right direction in a state where the liquid container 20 is attached to the stay 76 of the case 74.

Here, detailed description of the ink end sensor 80 will be omitted due to the configuration of the ink end sensor 80 being the same as the configuration of the ink end sensor 40 which is provided in the first liquid container unit 30.

Figure 9:
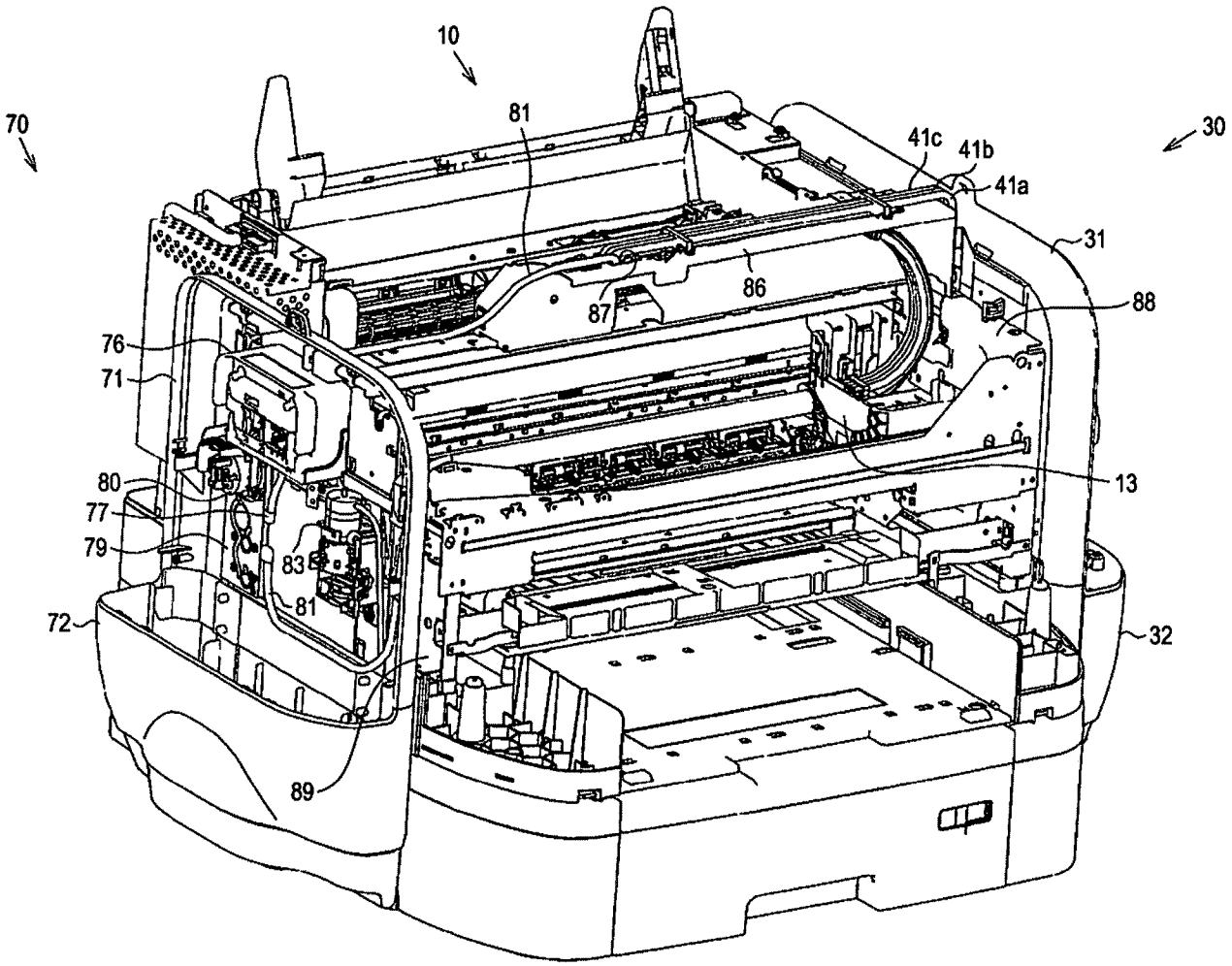
FIG. 9 is a perspective diagram of a recording apparatus which shows the arrangement format of a liquid supply tube.

Next, the arrangement format of the ink supply tubes 41*a*, 41*b*, 41*c*, and 81 in inner sections of the recording unit 10 will be described. FIG. 9 illustrates the recording unit 10 in a state where the scanner section 19, the operating panel 14, the paper supply cassette 18 (the upper side), and the paper discharge tray 17 of FIG. 1 are removed and a side surface cover 100 and front surface side covers 101, 102, and 103 are also removed. In addition, the liquid container units 30 and 70 are in a state where the lids 33 and 73 are removed.

A side wall frame 88 configures a right side wall section of the casing body 11 and a side wall frame 89 configures a left side wall section of the casing body 11. The side wall frames 88 and 89 support at least one out of a guide section (which is omitted from the diagrams) which supports the carriage 13 so as to be able to move back and forth, a paper supply mechanism (which is omitted from the diagrams) which supplies the paper P from the paper supply cassette 18 to the recording section, a transport mechanism (which is omitted from the diagrams) which transports the paper P, and a medium support section (which is omitted from the diagrams) which supports the paper P which is being transported.

The first liquid container unit 30 is mounted on the right side surface of the side wall frame 88 so as to be able to be attached and detached, and the second liquid container unit 70 is mounted on the left side surface of the side wall frame 89 so as to be able to be attached and detached.

As shown in FIG. 9, the recording unit 10 is provided with a support frame 86 which extends so as to cut across the recording unit 10. A through hole 87 is provided in a central section of the support frame 86 in the left and right direction of the recording unit 10.

The three ink supply tubes 41*a*, 41*b*, and 41*c* which are introduced from the first liquid container unit 30 into an inner section of the casing body 11 are guided upward along the side surface on the inner side of the casing body 11 and are inserted into the through hole 87 by being lead to the central section of the recording unit 10 along the support frame 86.

In addition, the ink supply tube 81 which is introduced from the second liquid container unit 70 into an inner section of the casing body 11 are guided upward along the side surface on the inner side of the casing body 11 and are inserted into the through hole 87 by being lead to the central section of the recording unit 10 along the support frame 86.

The four ink supply tubes 41*a*, 41*b*, 41*c*, and 81 which pass through the insertion hole 87 in the support frame 86 are bundled together and connected to the carriage 13 in a curved state.

Next, the actions of the present embodiment will be described.

The pumps 45 and 85 which send out the liquid which is contained in the liquid container 20 to the recording head 12 via the ink supply tubes are contained in the cases 34 and 74 which are provided in outer sections of the casing body 11 and which contain the liquid containers 20. For this reason, it is not necessary for the casing body 11 to be opened up when maintenance is carried out on the pump 45 and 85. In addition, since it is possible to carry out maintenance on the pumps 45 and 85 by opening up the cases 34 and 74, it is also not necessary to remove the cases 34 and 74 from the casing body 11. Due to this, maintenance on the pumps 45 and 85 is easy.

In addition, since the supports units which support the liquid containers 20 are provided in the cases 34 and 74 and the liquid containers 20 are contained in the cases 34 and 74, the liquid containers 20 are protected by the cases 34 and 74.

Here, since the liquid containers 20 are in the form of a bag which is formed from a flexible material, the liquid which is contained in inner sections of the liquid containers gathers at the lower sections due to gravity and the liquid containers 20 take a shape where the lower sections bulge compared to the upper sections in a state of hanging down from the stays 36*a*, 36*b*, 36*c*, and 76.

In the present embodiment, the pumps 45 and 85 are attached to the wall surfaces 35 and 75 so as to be positioned above the center Cv of the liquid containers 20 in the up and down direction in a state where the liquid containers 20 are attached to the stays 36*a*, 36*b*, 36*c*, and 76. For this reason, the pumps 45 and 85 are contained inside the cases 34 and 74 at positions where there is less bulging in the liquid containers 20, and interference between the pumps 45 and 85 and the liquid containers 20 is suppressed.

In addition, when the liquid which is contained in inner sections of the liquid containers 20 which are in the form of bags is suctioned out, the liquid containers 20 droop from the top toward the bottom. In addition, the liquid containers 20 also droop from both ends towards the center Cr in the left and right direction.

In the present embodiment, since the pumps 45 and 85 are provided at positions which are shifted from the center Cr of the liquid containers 20 in the left and right direction, the pumps 45 and 85 are positioned at portions where it is easy for the liquid containers 20 to droop when the printer is being used.

In addition, the plurality of stays 36*a*, 36*b*, and 36*c* and the diaphragm containing sections 39*a*, 39*b*, and 39*c* which number the same as the stays 36*a*, 36*b*, and 36*c* are provided in the case 34 of the first liquid container unit 30. Then, the one motor 43 is provided in order to operate the diaphragms which are provided in the diaphragm containing sections 39*a*, 39*b*, and 39*c*. For this reason, the number of motors which are necessary is fewer and the number of components is reduced compared to a case where the motor 43 is provided for each of the diaphragm containing sections 39*a*, 39*b*, and 39*c*.

In addition, since the ink end sensors 40 and 80 are contained in the cases 34 and 74 which are provided at outer sections of the recording unit 10, it is not necessary for the casing body 11 to be opened up when maintenance is carried out on the ink end sensors 40 and 80. In addition, since it is possible to carry out maintenance on the ink end sensors 40 and 80 by opening up the cases 34 and 74, it is also not necessary to remove the cases 34 and 74 from the casing body 11. Due to this, maintenance on the ink end sensors 40 and 80 is easy.

In addition, since the ink end sensors 40 and 80 and the pumps 45 and 85 are arranged in the cases 34 and 74, it is possible for the ink supply tubes 41*a*, 41*b*, 41*c*, and 81 to be directly guided to the carriage 31 without going through other components inside the recording unit 10. For this reason, the design freedom is improved and guiding of the ink supply tubes 41*a*, 41*b*, 41*c*, and 81 is easy.

According to the present embodiment, the following effects are able to be obtained.

(1) Since the pumps 45 and 85 are contained in the cases 34 and 74, it is no longer necessary for the casing body 11 to be opened up and it is no longer necessary for the cases 34 and 74 to be removed from the casing body 11 when maintenance is carried out on the pumps 45 and 85. For this reason, it is possible to easily perform maintenance on the pumps 45 and 85.

(2) Since the support units which support the liquid containers 20 are provided in the cases 34 and 74 and the liquid containers 20 are contained in the cases 34 and 74, it is possible to protect the liquid containers 20 using the cases 34 and 74. In addition, since there is a reduction in the targets which are typically removed even with the cases 34 and 74 being removed when maintenance is carried out on the pumps 45 and 85 compared to a case where the side surface cover 100, the front surface side covers 101, 102, and 103, and the like are removed, it is possible to reduce the operation area when maintenance is carried out.

(3) The pumps 45 and 85 are attached to the wall surfaces 35 and 75 so as to be positioned above the center Cv of the liquid containers 20 in the up and down direction in a state where the liquid containers 20 are attached to the stays 36*a*, 36*b*, 36*c*, and 76. For this reason, interference between the pumps 45 and 85 and the liquid containers 20 is suppressed and it is possible for the pumps 45 and 85 to be contained in the cases 34 and 74 without the cases 34 and 74 increasing in size.

(4) The pumps 45 and 85 are attached at positions which are shifted from the center Cr of the liquid containers 20 in the left and right direction in a state where the liquid containers 20 are attached to the stays 36*a*, 36*b*, 36*c*, and 76. For this reason, the pumps 45 and 85 are positioned at portions where it is easy for the liquid containers 20 to droop when the printer is being used, and it is possible for interference between the pumps 45 and 85 and the liquid containers 20 to be further suppressed.

(5) Since only one of the motors 43 for operating the diaphragms which are provided in the diaphragm containing sections 39*a*, 39*b*, and 39*c* is provided in the case 34 of the first liquid container unit 30, the number of motors is fewer than a case where motors are provided for each of the diaphragm containing sections 39*a*, 39*b*, and 39*c*, and it is possible to achieve a reduction in the number of components.

(6) Since the ink end sensors 40 and 80 are contained in the cases 34 and 74 which are provided at outer sections of the recording unit 10, maintenance on the ink end sensors 40 and 80 is easy.

Here, it is possible for the embodiment described above to be realized through the following modifications.

There may be as many as of the motors 43 which are provided in the first liquid container unit 30 as there are of the diaphragm containing sections 39*a*, 39*b*, and 39*c*. In this case, a first motor may be connected to the diaphragm containing section 39*a*, a second motor may be connected to the diaphragm containing section 39*b*, and a third motor may be connected to the diaphragm containing section 39*c*. According to this configuration, it is possible for the amount of ink which is suctioned out from the respective liquid containers 20 to be individually controlled.

The ink end sensors 40 and 80 are not limited to the configuration described above and appropriate modifications are possible. For example, each of the stays are not directly fixed to the cases 34 and 74 but are fixed to the cases 34 and 74 in a state of hanging down using springs, and support walls which abut with lower ends of the stay are provided to protrude from inner surfaces of the cases 34 and 74. Then, contact switches are provided so as to transmit signals to the control substrate 15 when the stays abut with the support walls. According to this configuration, in a state where the liquid container 20 is attached to the stay and the stay sags down due to the weight of the liquid container 20, a state is maintained where the stay and the contact switch abut and signals are transmitted. On the other hand, when the amount of ink which is contained in the liquid container 20 is reduced and the weight of the liquid container 20 becomes lighter, the stay is pulled upward due to the pressing force of the spring and separates from the contact switch and signals are no longer transmitted from the contact switch. For this reason, it is possible for the control substrate 15 to detect that the remaining amount of ink is equal to or less than a specific value based on the signal from the contact switch being cut off. Here, there is description of the configuration described above such that a signal is generated when the contact switch abuts with the stay, but a signal may be generated when the contact switch separates from the stay. In this case, it is detect that the remaining amount of ink is equal to or less than a specific value based a signal being generated when the contact switch is separated from the stay. The point is that it is sufficient if a means, which is able to detect reductions in the remaining amount of ink in the liquid containers 20, is adopted as the ink end sensors.

The ink end sensors 40 and 80 may be provided in inner sections of the casing body 11 without being contained in the cases 34 and 74.

The ink end sensors 40 and 80 need not be provided. In this case, it is sufficient if the number of ink dots which are ejected from the recording head 12 is counted and it is estimated that the remaining amount of ink is equal to or less than a specific value when the counting of ink dots is equal to or more than a specific number.

Ink inside the ink chambers is pushed out due to the diaphragms which are bent toward the air chamber side bending back the other way by air being released from the air chambers which are provided in the diaphragm containing sections 39*a*, 39*b*, 39*c*, and 79, but ink inside the ink chambers may be pushed out due to the diaphragms bending toward the ink chamber side due to air being sent from the motors 43 and 83 into the air chambers.

An example of the photo interrupter 64 is described where a signal is generated when the light receiving section 63 does not detect light, but the configuration of the photo interrupter 64 is not limited to this and appropriate modifications are possible. For example, a signal may be generated when the light receiving section 63 detects light. In this case, ink is suctioned up from the liquid container 20 and supplied to the recording head 12 by the motor 43 being driven when signals are no longer generated. Then, the control substrate 15 determines that the liquid container 20 is empty and outputs a replacement sign in a case when the state where signals are not generated does not end for a specific period of time or more even when the motor 43 is driven. In addition, the output signal may be switched depending on whether or not the light receiving section 63 detects light. For example, a first signal may be output when the light receiving section 63 detects light and a second signal which is different to the first signal may be output when the light receiving section 63 does not detect light. In this case, ink is suctioned up from the liquid container 20 and supplied to the recording head 12 by the motor 43 being driven when the second signal is output. Then, the control substrate 15 determines that the liquid container 20 is empty and outputs a replacement sign in a case where the state where the signal is output as the second signal does not end for a specific period of time or more even when the motor 43 is driven.

The pumps 45 and 85 may be attached to the wall surfaces 35 and 75 so as to be positioned at the center Cr of the liquid containers 20 in the left and right direction. In addition, the pumps 45 and 85 may be attached to the wall surfaces 35 and 75 so as to be positioned at the center Cv of the liquid containers 20 in the up and down direction and may be attached to the wall surfaces 35 and 75 so as to be positioned below the center Cv of the liquid containers 20 in the up and down direction.

The ink end sensors 40 and 80 may be attached to the wall surfaces 35 and 75 so as to be positioned at the center Cr of the liquid containers 20 in the left and right direction. In addition, the ink end sensors 40 and 80 may be attached to the wall surfaces 35 and 75 so as to be positioned at the center Cv of the liquid containers 20 in the up and down direction and may be attached to the wall surfaces 35 and 75 so as to be positioned below the center Cv of the liquid containers 20 in the up and down direction.

The positions where the pumps 45 and 85 are attached are not limited to inside the cases. For example, the pumps 45 and 85 may be attached at portions between the cases 34 and 74 and the casing body 11.

Figure 10:
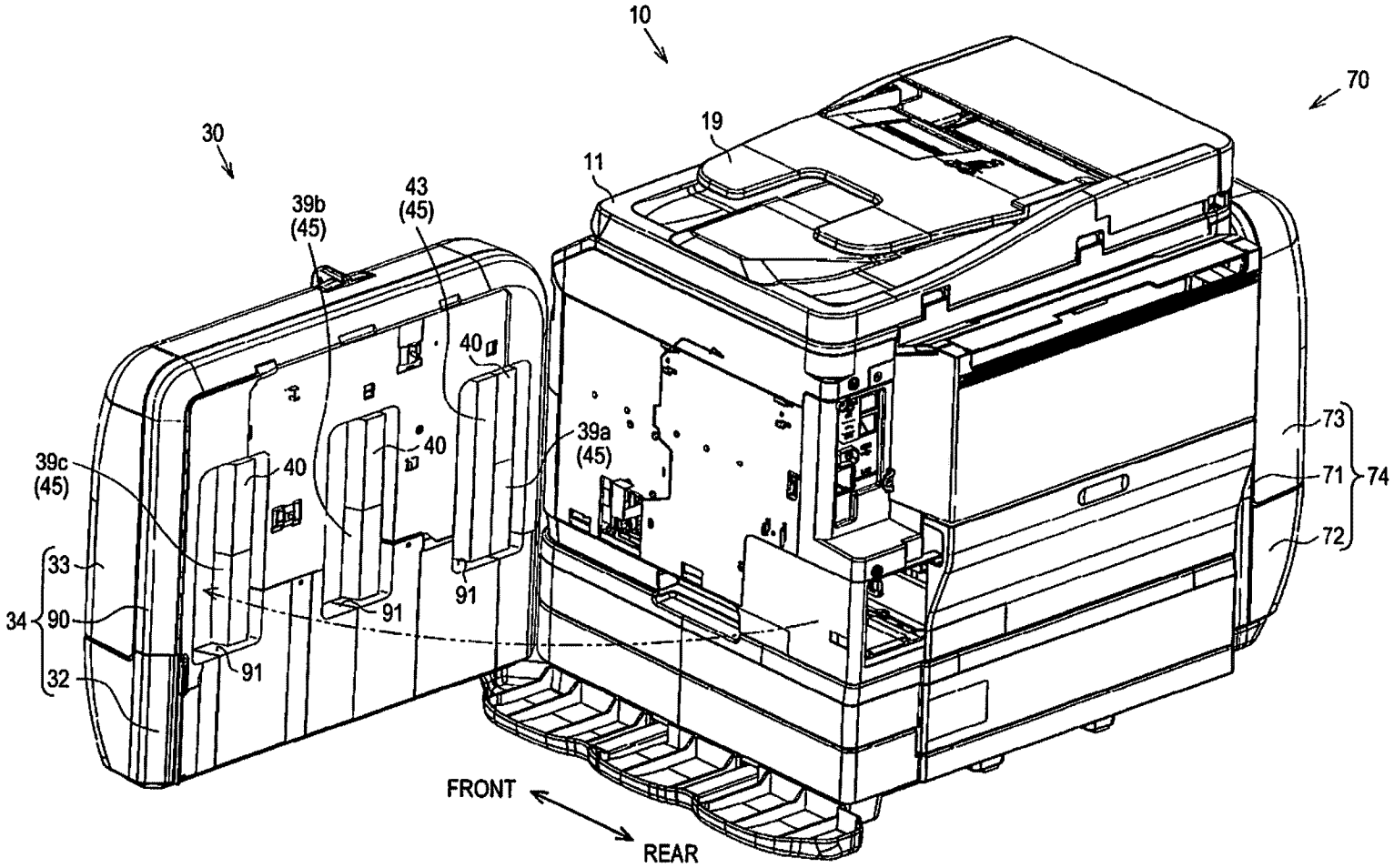
FIG. 10 is a perspective diagram illustrating a recording apparatus as in another embodiment.

Here, when attempting to simply attach the pumps 45 and 85 to portions between the cases 34 and 74 and the casing body 11, it is necessary for space to be provided by the gaps between the side wall forming members 31 and 71 and the casing body 11 being widened in order for the pumps 45 and 85 to be contained and there is a concern that the printer will increase in size. For this reason, it is desirable to adopt the configuration which is shown in FIG. 10 in a case where the pumps 45 and 85 are provided at outer sections of the cases 34 and 74. Here, the configuration of the side wall forming members 31 of the first liquid container unit 30 is different in the configuration which is shown in FIG. 10 to the embodiment described above, and the same reference numerals will be given to the same configurations as the embodiment described above and detailed description will be omitted.

As shown in FIG. 10, a plurality of recess sections 91 which are indented towards the inner section of the case 34 are provided in the outer surface of a side wall forming member 90 in the first liquid container unit 30. The diaphragm containing sections 39*a*, 39*b*, and 39*c* and the ink end sensors 40 are each contained in the recess sections 91 and the motor 43 is contained in one out of the recess sections 91. Each of the recess sections 91 are provided with through holes which communicate with the inside of the case 34. For this reason, it is possible for the diaphragm containing sections 39*a*, 39*b*, and 39*c* to communicate with the liquid containers 20 by the ink supply tubes 37*a*, 37*b*, and 37*c* being inserted through the through holes.

According to this configuration, it is possible for maintenance to be performed on the pump 45 which is contained in the recess section 91 by the case 34 being removed from the casing body 11 and the case 34 being rotated with regard to the casing body 11 as shown by the arrow in FIG. 10 without the casing body 11 being opened up. For this reason, maintenance on the pump 45 is easy. In addition, since the recess section 91 is provided in the outer surface of the case 34 and the pump 45 is contained in the recess section 91, it is not necessary for space to be provided by the gap between the case 34 and the casing body 11 being widened in order for the pump 45 to be contained. Accordingly, it is possible to attach the pump 45 to the case 34 while also suppressing the printer from increasing in size.

Figure 11:
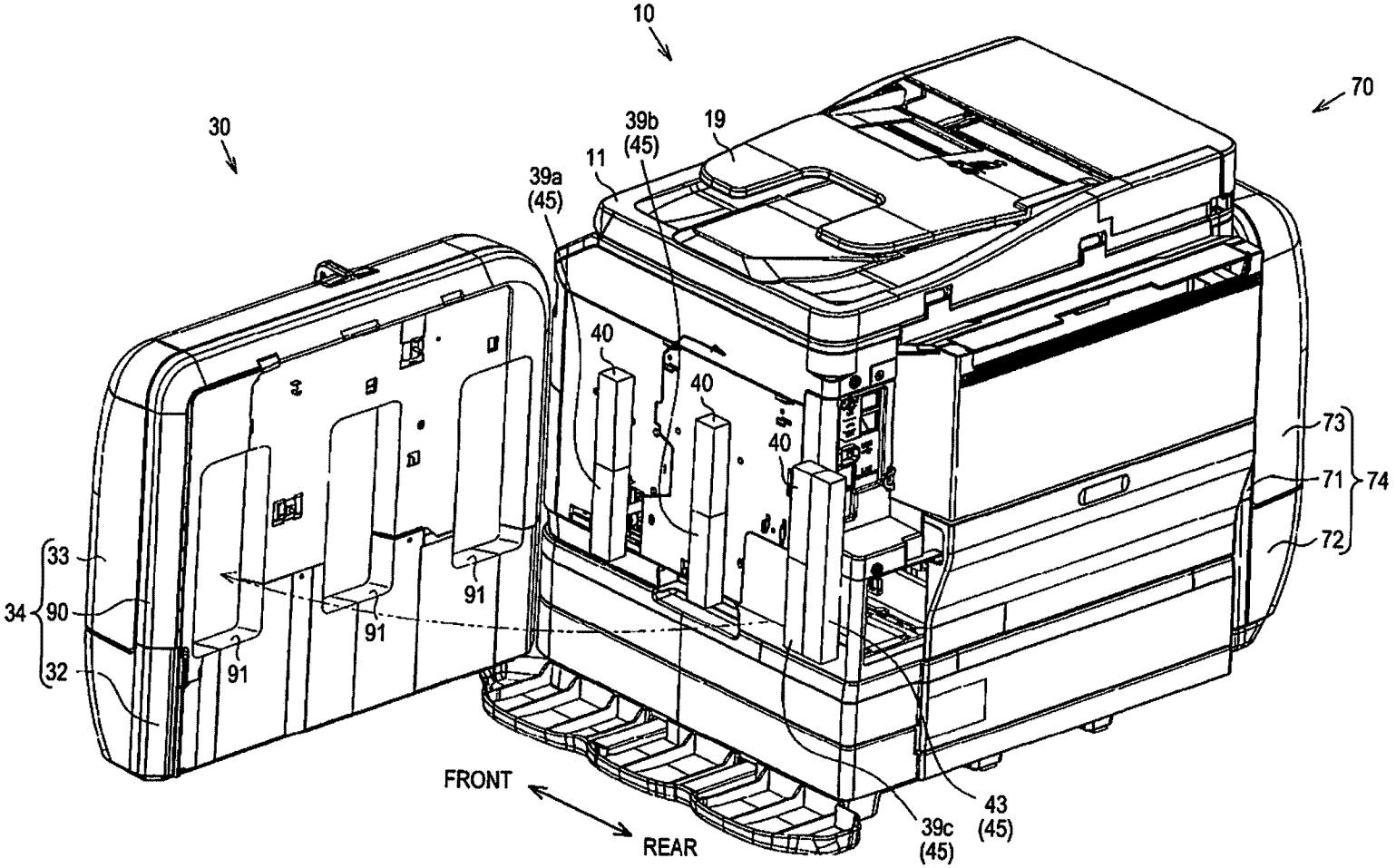
FIG. 11 is a perspective diagram illustrating a recording apparatus as in another embodiment.

Here, the pump 45 is attached to the outer surface of the case 34 in the configuration described above, but the pump 45 may be attached to the right side surface of the casing body 11 as shown in FIG. 11 if it is possible for the pump 45 to be attached to a portion which is between the case 34 and the casing body 11. Even with this configuration, since the pump 45 is positioned between the support unit and the casing body when the case 34 is attached to the casing body 11, that is, when the support unit is mounted in the casing body 11, it is possible to perform maintenance on the pump 45 by removing the case 34 from the casing body 11 and it is possible to easily perform maintenance on the pump 45. Here, if the plurality of recess sections 91 which are indented towards the inner section of the case 34 are provided in the outer surface of the side wall forming member 90 in the first liquid container unit 30 as shown in FIG. 11, it is not necessary for space to be provided by the gap between the case 34 and the casing body 11 being widened in order for the pump 45 to be contained due to the pump 45 being contained in the recess section 91 which is provided in the outer surface of the case 34. Accordingly, it is possible to attach the pump 45 to the casing body 11 while also suppressing the printer from increasing in size.

Figure 12:
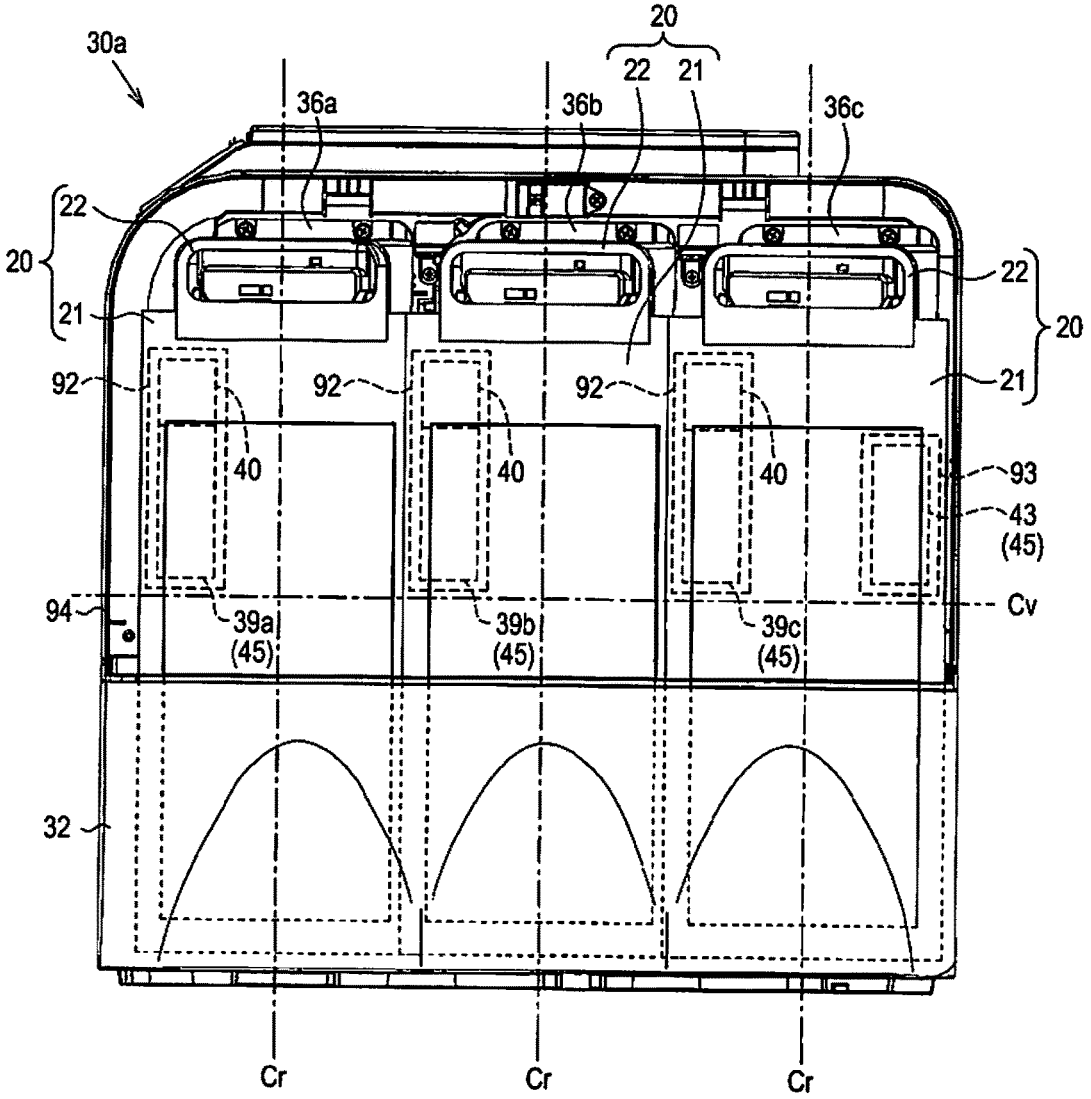
FIG. 12 is a perspective diagram illustrating a first liquid container unit where a liquid container is attached as in another embodiment.

FIG. 12 is a diagram viewing a first liquid container unit 30*a* from a side surface in a state where the liquid containers 20 are attached and the lid 33 (refer to FIG. 10) is removed. Convex sections 92 are formed in three locations and a convex section 93 is formed in one location in the inner surface of the side wall forming member 94. The convex sections 92 and 93 have a convex shape which protrudes toward the inner section of the case 34 when viewed from the inner side of the case 34 so that a plurality of recess sections (which are omitted from the diagrams) which are indented toward the inner section of the case 34 are provided in the outer surface of the side wall forming member 94 in the same manner as the recess sections 91.

The diaphragm containing sections 39*a*, 39*b*, and 39*c* and the ink end sensors 40 which are provided at the side surface of the casing body 11 are contained in the recess sections on the opposite side to the convex sections 92, that is, the recess sections when viewed from the outer side of the case 34. The motor 43 which is provided at the inner surface of the casing body 11 is contained in the recess section on the opposite side to the convex sections 93, that is, the recess section when viewed from the outer side of the case 34.

Through holes which communicate with the inside of the case 34 are provided in the recess sections which are formed with the convex sections 92 in the outer side of the case 34 and it is possible for the diaphragm containing sections 39*a*, 39*b*, and 39*c* to communicate with the liquid container 20 by the ink supply tubes 37*a*, 37*b*, and 37*c* being inserted into the through holes.

As shown in FIG. 12, the convex sections 92 and 93 are attached at positions above the center Cv of the liquid containers 20 in the up and down direction when viewing the case 34 from the side surface. In addition, the convex sections 92 and 93 are attached at positions which are shifted from the center Cr of each of the liquid containers 20 in the left and right direction.

Due to this configuration, the convex sections 92 and 93 are positioned at portions where it is easy for the liquid containers 20 to droop when the printer is being used, and it is possible to further suppress interference between the convex sections 92 and 93 and the liquid container 20.

In addition, it is possible for each of the configurations described above to be applied to the second liquid container unit 70 in the same manner.

An example of the pumps 45 and 85 is described where the motors 43 and 83 are adopted as the actuators, but actuators other than the motors may be adopted.

The pumps which send the ink which is contained in the liquid containers 20 to the recording head 12 are not limited to the diaphragm pumps 45 and 85 and another type of pump may be adopted. For example, gear pumps which send ink inside the ink supply tubes in one direction using gears may be adopted.

Three of the liquid containers 20 are contained in the first liquid container unit 30 and one of the liquid containers 20 is contained in the second liquid container unit 70, but the number of the liquid containers 20 may be appropriately modified. In addition, only one out of the first liquid container unit 30 and the second liquid container unit 70 may be provided.

An example of the liquid container 20 is described such that ink is contained in a bag which is formed from a flexible material, but the liquid containers 20 may have another configuration. For example, ink may be contained in a box which is formed using resin.

The liquid container 20 may be an exchangeable type of liquid container where, in a case where the liquid container 20 is empty, the empty liquid container 20 may be exchanged for the liquid container 20 which is new and fill with ink, or the liquid container 20 may be a refillable type of liquid container where, in a case where the liquid container 20 is empty, the empty liquid container 20 may be filled with ink.

The cases 34 and 74 need not be provided if it is possible for the liquid containers 20 to be supported. For example, only the side wall forming members 31 and 71 may be provided in the configuration described above with the lids 33 and 73 and the bottom forming members 32 and 72 not being provided. Even in this case, it is possible for the side wall forming members 31 and 71 and the stays to function as the support unit which supports the liquid containers 20 by the stays being fixed to the side wall forming members 31 and 71 and the liquid containers 20 being fixed to the stays. Here, in this configuration, the liquid containers 20 are provided in a state of being exposed to the outside.

In addition, only the bottom forming members 32 and 72 with the bottomed box shape may be provided with the lids 33 and 73 and the side wall forming members 31 and 71 not being provided. In this case, the bottom forming members 32 and 72 are the support unit which supports the liquid containers 20 due to the liquid containers 20 being placed on inner sections of the bottom forming members 32 and 72.

In the present embodiment, the first liquid container unit 30 and the second liquid container unit 70 are respectively mounted on the side wall frames 88 and 89 so as to be freely attached and detached, but the first liquid container unit 30 and the second liquid container unit 70 may be respectively mounted on covers which are provided on the outer side of the side wall frames 88 and 89 so as to be freely attached and detached.

In each of the embodiments described above, the recording apparatus may be a recording apparatus which performs recording by ejecting or discharging liquids other than ink. For example, the recording apparatus may be a recording apparatus which performs recording by ejecting a liquid body which includes materials such as electrode materials or colorants (pixel materials) being dispersed or dissolved so as to be used in manufacturing liquid crystal displays, EL (electroluminescent) displays, field emission displays, and the like. In addition, the recording apparatus may be a recording apparatus which ejects fluid bodies such as gels (for example, physical gels).

DESCRIPTION OF REFERENCE NUMERALS

10 RECORDING UNIT
11 CASING BODY
12 RECORDING HEAD
13 CARRIAGE
14 OPERATING PANEL
15 CONTROL SUBSTRATE
16 PAPER DISCHARGE OPENING
17 PAPER DISCHARGE TRAY
18 PAPER SUPPLY CASSETTE
19 SCANNER SECTION
20 LIQUID CONTAINER
21 INK PACK
22 HANDLE SECTION
23 IC CHIP
30 FIRST LIQUID CONTAINER UNIT
31 SIDE WALL FORMING MEMBER
32 BOTTOM FORMING MEMBER
33 LID
34 CASE
35 SIDE SURFACE
36*a*, 36*b*, 36*c* STAY
37*a*, 37*b*, 37*c* INK SUPPLY TUBE
38 LIQUID SUPPLY NEEDLE
39*a*, 39*b*, 39*c* DIAPHRAGM CONTAINING SECTION
40 INK END SENSOR
41*a*, 41*b*, 41*c* INK SUPPLY TUBE
42 THROUGH HOLE
43 MOTOR
44 AIR SUPPLY AND DISCHARGE TUBE
45 PUMP
46 FILM
47 BUFFER CHAMBER
48 INK FLOW INLET
49 INK FLOW OUTLET
50 PISTON
51 ABUTTING SECTION
52 SHAFT SECTION
53 CYLINDRICAL SECTION
54 HOUSING
55 SUPPORT SECTION
56 COMPRESSION SPRING
57 HEAD SECTION
58 LEVER
59 ROTATION SHAFT
60 SHIELD SECTION
61 NOTCH SECTION
62 TENSION SPRING
63 LIGHT RECEIVING SECTION
64 PHOTO INTERRUPTER
70 SECOND LIQUID CONTAINER UNIT
71 SIDE WALL FORMING MEMBER
72 BOTTOM FORMING MEMBER
73 LID
74 CASE
75 SIDE SURFACE
76 STAY
77 INK SUPPLY TUBE
78 LIQUID SUPPLY NEEDLE
79 DIAPHRAGM CONTAINING SECTION
80 INK END SENSOR
81 INK SUPPLY TUBE
82 THROUGH HOLE
83 MOTOR
84 AIR SUPPLY AND DISCHARGE TUBE
85 PUMP
86 SUPPORT FRAME
87 THROUGH HOLE
88, 89 SIDE WALL FRAME
90 SIDE WALL FORMING MEMBER
91 RECESS SECTION

The invention claimed is:

1. A recording apparatus comprising:
a recording section which performs recording by ejecting a liquid onto a recording medium;
a frame which holds the recording section;
a support unit which is provided on an outer side of the frame and which supports a liquid container which contains the liquid which is to be ejected from the recording section;
a liquid supply tube which supplies the liquid which is contained in the liquid container to the recording section;
a case which is provided on the outer side of the frame and contains the liquid container; and
a pump which is contained in the case and which sends the liquid which is contained in the liquid container to the recording section via the liquid supply tube.

2. The recording apparatus according to claim 1,
wherein the support unit is provided so as to he freely attached and detached with regard to the frame.

3. The recording apparatus according to claim 1, further comprising:
a cover which covers the frame,
wherein the support unit is provided to he freely attached and detached with regard to the cover.

4. A recording apparatus comprising:
a recording section;
a frame which holds the recording section;
a support unit which is provided on an outer side of the frame and which supports a liquid container which contains the liquid which is to be ejected from the recording section;
a liquid supply tube which supplies the liquid which is contained in the liquid container to the recording section;
a pump which is arranged in the support unit and which sends the liquid which is contained in the liquid container to the recording section via the liquid supply tube; and
a case which contains the liquid container,
the support unit being provided in the case.

5. The recording apparatus according to claim 4,
wherein the pump is attached to a portion which is positioned between the frame and the case when the case is mounted on the cover.

6. The recording apparatus according to claim 4, wherein the pump is attached to a portion which is positioned between the frame and the case when the case is mounted on the frame.

7. The recording apparatus according to claim 6, wherein the pump is contained in a recess section which is provided in the outer surface of the case.

8. The recording apparatus according to claim 4, wherein the pump is contained in the case.

9. The recording apparatus according to claim 8, wherein the liquid container contains the liquid which is to be supplied to the recording section in a bag which is formed from a flexible material, a hanging mechanism to which the liquid container in a state of hanging down is fixed to an inner surface of the case, and the pump is attached to the inner surface so as to be positioned above the center of the liquid container in the up and down direction in a state where the liquid container is attached to the hanging mechanism.

10. The recording apparatus according to claim 9, wherein the pump is attached at a position which is shifted from the center of the liquid container in the left and right direction in a state where the liquid container is attached to the hanging mechanism.

11. A recording apparatus comprising:

a recording section;

a frame which holds the recording section;

a support unit which is provided on an outer side of the frame and which supports a liquid container which contains the liquid which is to be ejected from the recording section;

a liquid supply tube which supplies the liquid which is contained in the liquid container to the recording section; and a pump which is arranged in the support unit and which sends the liquid which is contained in the liquid container to the recording section via the liquid supply tube, the support unit being provided with a plurality of hanging mechanisms to which the liquid containers in a state of hanging down are attached, the pump being a diaphragm pump which has diaphragms which are provided in liquid supply paths from the liquid containers to the recording head and which suctions up the liquid which is contained in the liquid containers and supplies the liquid to the recording section due to the diaphragms being bent using an actuator, and as many of the diaphragms being provided as the number of the hanging mechanisms and one actuator which is connected to each of the diaphragms being provided.

* * * * *